US007807907B2

(12) United States Patent
Inoue

(10) Patent No.: US 7,807,907 B2
(45) Date of Patent: Oct. 5, 2010

(54) KEYBOARD MUSICAL INSTRUMENT AND ACTION UNIT INCORPORATED THEREIN

(75) Inventor: Satoshi Inoue, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 12/275,917

(22) Filed: Nov. 21, 2008

(65) Prior Publication Data

US 2009/0173206 A1 Jul. 9, 2009

(30) Foreign Application Priority Data

Jan. 8, 2008 (JP) ..... 2008-001249

(51) Int. Cl.
*G10C 3/22* (2006.01)

(52) U.S. Cl. ..... 84/243; 84/234; 84/236; 84/239; 84/436; 84/439

(58) Field of Classification Search ..... 84/234, 84/236, 239, 243, 436, 439
See application file for complete search history.

(56) References Cited

U.S. PATENT DOCUMENTS 269,405 A * 12/1882 Gemünder ..... 84/239
939,362 A * 11/1909 Wessell et al. ..... 84/239
1,411,820 A * 4/1922 Waggett ..... 84/236
1,586,547 A * 6/1926 Eastwood ..... 84/240
1,900,488 A * 3/1933 Dasenbrook ..... 84/239
2,524,835 A 10/1950 Ringholz
4,685,371 A * 8/1987 Levinson ..... 84/239
4,856,402 A * 8/1989 Alexander ..... 84/239
5,434,349 A * 7/1995 Kawamura ..... 84/719
6,515,213 B2 * 2/2003 Muramatsu et al. ..... 84/687
6,740,801 B2 * 5/2004 Yoshisue et al. ..... 84/452 P
7,169,990 B2 * 1/2007 Yoshisue ..... 84/236
7,678,977 B2 * 3/2010 Yoshisue et al. ..... 84/234
2002/0189422 A1 12/2002 Yoshisue et al.
2007/0068359 A1 * 3/2007 Wroblewski ..... 84/236
2009/0173206 A1 * 7/2009 Inoue ..... 84/243

FOREIGN PATENT DOCUMENTS

JP 7-46270 5/1995

* cited by examiner

*Primary Examiner*—Jeffrey Donels
*Assistant Examiner*—Robert W Horn
(74) *Attorney, Agent, or Firm*—Dickstein Shapiro LLP

(57) ABSTRACT

A grand piano has action units for driving hammers to rotate toward strings, and each action unit is equipped with a repetition mechanism; the repetition mechanism has an elastic guide plate instead of a repetition lever and a repetition spring; and the elastic guide plate per se is deformed after contact with a drop screw, and returns to the initial position for permitting a pianist to play a music tune through repetition of key when the pianist releases the depressed key, whereby the action unit becomes simpler in structure than the conventional action unit.

20 Claims, 5 Drawing Sheets

KEYBOARD MUSICAL INSTRUMENT AND ACTION UNIT INCORPORATED THEREIN

FIELD OF THE INVENTION

This invention relates to a keyboard musical instrument and, more particularly, to a keyboard musical instrument transmitting key movements to hammers through action units and the action units incorporated therein.

DESCRIPTION OF THE RELATED ART

An acoustic piano is categorized in the keyboard musical instrument. A player is assumed to depress a key of the acoustic piano. The key movement is transmitted from the depressed key to the hammer through the action unit, and the action unit gives rise to rotation of the hammer. The hammer is brought into collision with the string, and gives rise to vibrations of the string for generating the acoustic piano tone. Thus, the action units are indispensable component parts of the acoustic piano.

In the following description, term "front" is indicative of a position closer to a player, who is sitting on a stool in front of the acoustic piano, than a position modified with term "rear". A line drawn between a front position and a rear position extends in a "fore-and-aft" direction, and a "lateral" direction crosses the fore-and-aft direction at right angle. An "up-and-down" direction is normal to a plane defined by the fore-and-aft direction and lateral direction. "Clockwise direction" and "counter clockwise direction" are determined on the sheet of paper just where a figure, which is just referred to, is drawn.

A typical example of the action unit is disclosed in Japanese Patent Publication No. Hei 7-46270, and is illustrated in FIG. 1. The prior art action unit is designated by reference ACT1. The other essential component parts of prior art grand piano are piano cabinet CBT1, a keyboard 30A, hammers 11, dampers DMP1 and strings 19. An inner space is defined in the piano cabinet CBT1, and a key bed KBD1 is exposed to the inner space.

The keyboard 30A is mounted on the key bed KBD1, and includes a balance rail BRL1, plural keys 30 and capstan crews 4. The balance rail BRL1 extends in the lateral direction, and the plural keys 30 extend in parallel to one another over the balance rail BRL1 in the fore-and-aft direction. The keys 30 independently pitch up and down. When a pianist depresses the front portion of key 30, the front portion is sunk, and the rear portion is raised. The capstan screws 4 are implanted into the rear portions of keys 30, respectively, and are upright on the upper surfaces of rear portions of keys 30.

Action brackets ABL1 stand on the key bed KBD1, and are spaced from each other in the lateral direction. A support rail 3 and a hammer shank rail 10 extend in the lateral direction. The support rail 3 is bolted to the lower rear portions of action brackets ABL1, and the hammer shank rail 10 is bolted to the upper front portions of action brackets ABL1. Thus, the support rail 3 and hammer shank rail 10 extend over the rear portions of keys 30.

The action units ACT1 are respectively provided in association with the keys 30. The action units ACT1 are rotatably supported by the support rail 3 through support flanges 2, and are held in contact with the capstan screws 4.

Each of the action units ACT1 includes a whippen 5, a jack 6, a repetition lever flange 7, a repetition lever 8, a repetition lever spring 12, a repetition lever button 15, a shank stop felt 20, a regulating button 25 and a back check 35, and gives rise to the rotation of hammer 11.

The whippen 5 extends in the fore-and-aft direction, and has a rear portion 5*a*, a lower portion and a front portion 5*b*. The rear portion 5*a* of whippen 5 is rotatably connected to the support flange 2 in the clockwise direction and counter clockwise direction by means of a pin 23, and the shank stop felt 20 is fitted to the upper surface of the rear portion 5*a* of whippen 5. The capstan screw 4 is held in contact with the lower portion of whippen 5. For this reason, while the rear portion of key 30 is rising, the capstan screw 4 pushes the lower portion of whippen 5 in the upward direction, and gives rise to rotation of whippen 5 about the support flange 2.

The jack 5 is rotatably connected to the rear portion of whippen 5 by means of a pin 36, and is rotatable in the clockwise direction and counter clockwise direction. The jack 5 has an L-letter shape, and, accordingly, has a leg portion 6*a* and a foot portion. The leg portion 6*a* rearwardly upwardly extends over the upper surface of front portion 5*b*, and the foot portion projects in the frontward direction from the pin 36. The foot portion of jack 5 is formed with a toe 6*b*.

A regulating rail 100 extends in the lateral direction, and is bolted to the hammer shank rail 10. The regulating button 25 is connected to the regulating rail 100, and is hung from the regulating button 25 in such a manner as to be opposed to the toe 6*b*. The regulating button 25 is rotatable. The regulating button 25 downwardly projects from and is retracted toward the regulating rail 100 through the rotation thereof.

While the whippen 5 is rotating about the pin 23, the toe 6*b* is getting closer and closer to the regulating button 25. When the toe 6*b* is brought into contact with the regulating button 25, the jack 6 rotates about the pin 36 due to the reaction from the regulating button 25.

The jack 6 further includes a jack button 31, a jack screw 32 and a jack stop spoon 33. The jack screw 32 is held in threaded engagement with the leg portion 6*a*, and projects from both of the front and rear surfaces of the leg portion 6*a*. The jack button 32 is fitted to the rear end of jack screw 32. The jack stop spoon 33 is embedded in the front portion of whippen 6*a*, and is spaced from and bought into contact with the jack stop spoon 33 depending upon the direction of rotation of jack 6. While the key 30 is staying at the rest position, the jack button 31 is held in contact with the jack stop spoon 33, and the contact position is changeable by means of the jack screw 32.

The repetition lever flange 7 is connected to an intermediate portion of the whippen 5, and is upright from the intermediate portion of whippen 5. The repetition lever 8 is rotatably connected to the repetition lever flange 7 by means of a pin 7*a*, and has a front portion and a rear portion. The front portion of repetition lever 8 is formed with a hole 21, and the leg portion 6*a* is inserted into the hole 21. The thickness of leg portion 6*a* is greater than the length of hole 21 so that the leg portion 6*a* is moveable in the hole 21. The upper surface 22 of leg portion 6*a* is almost coplanar with the upper surface of the repetition lever 16.

The repetition lever button 15 is hung from the rear portion of repetition lever 8, and is spaced from and brought into contact with the upper surface of the rear portion 5*a* of whippen 5 depending upon the direction of rotation of whippen 5.

The repetition lever spring 12 is turned back so that two arms 12*a* and 12*b* take place. The arm 12*a* is held in contact with the jack 6, and the other arm 12*b* is held in contact with the repetition lever 8. The jack 6 is urged in the counter clockwise direction so that the toe 6*b* is spaced from the regulating button 25 during the stay of key 30 at the rest position. On the other hand, the arm 12*b* urges the repetition lever 8 in the counter clockwise direction so that the repetition lever button 15 is held in contact with the rear portion 5*a* of whippen 5. As described hereinbefore, the repetition lever spring 12 urges the repetition lever 8 in the counter clockwise direction, and the repetition lever button 15 is pressed to the upper surface of whippen 5. Reaction is exerted on the repetition lever button 15 so that the repetition lever 8 is not permitted further to rotate.

The back check 35 projects from the rear portion of key 30, and the hammer 11 is received by the back check 35 after rebound on the string 19.

The hammers 11 are supported by the hammer shank rail 10 over the action units ACT1, and the strings 19 are stretched over the hammers 11, respectively. Each of the hammers 11 includes a hammer shank flange 9, a hammer roller 14, a hammer shank 16, a hammer wood 17, a hammer felt 18 and a repetition screw 34.

The hammer shank flange 9 is bolted to the hammer shank rail 100, and the hammer shank 16 is rotatably connected to the hammer shank flange 9 by means of a pin 13. The repetition screw 34 downwardly projects from the hammer shank flange 9, and the distance between the lower surface of repetition screw 34 and the lower surface of hammer shank flange 9 is regulable through rotation.

The hammer shank 16 extends from the hammer shank flange 9 in the rearward direction, and the hammer wood 17 is fitted to the free end portion of the hammer shank 16. The hammer felt 18 is fitted to the hammer wood 17.

The hammer roller 14 is hung from the hammer shank 16, and is rotatable. While the key 30 is staying at the rest position, the hammer roller 14 is held in contact with the upper surface of front portion of hammer shank 16.

The dampers DMP1 are linkable with the rear portions of keys 30, and are spaced from and brought into contact with the associated strings 19 depending upon the positions of keys 30. While the keys 30 are staying at the rest positions, the rear positions of keys 30 are spaced from the dampers DMP1, and the dampers DMP1 are held in contact with the strings 19 so as to prohibit the strings 19 from vibrations. On the other hand, the depressed keys 30 exert force on the associated dampers DMP1 in the upward direction on the way to the end positions. The associated dampers DMP1 are spaced from the strings 19, and permit the associated strings 19 to vibrate upon collision between the hammer felts 18 and the strings 19.

The prior art action unit ACT1 behaves as follows. While a pianist is keeping his or her thumbs and fingers spaced from the keys 30, the self-weight of action units ACT is exerted on the rear portions of keys 30, and the keys 30 are staying at the rest positions. The action units ACT1 and hammers 11 and dampers DMP1 stay at their rest positions shown in FIG. 1.

When a pianist depresses the front portion of one of the keys 30, the key 30 starts to travel from the rest position toward the end position. The depressed key 30 makes the associated damper DMP1 spaced from the string 19 on the way to the end position. While the depressed key 1*a* is traveling from the rest position toward the end position, the rear portion of depressed key pushes the lower portion of whippen 5, and gives rise to rotation of the whippen 5 in the counter clockwise direction. The repetition lever 8 rotates together with the whippen 5. Force is exerted on the hammer roller 14 through the repetition lever 8, and the hammer 11 rotates about the pin 13. While the whippen 5 is rotating in the counter clockwise direction, the toe 6*b* is getting closer and closer to the regulating button. However, the repetition lever spring 12 prohibits the jack 6 from the rotation about the pin 36.

When the front portion of repetition lever 8 is brought into contact with the repetition screw 34, the repetition screw 34 prohibits the front portion of repetition lever 8 to be moved together with the whippen 5 without any relative rotation. The reaction from the repetition screw 34 gives rise to the rotation of repetition lever 8 in the clockwise direction, and the supper surface 22 of leg portion 6*a* is brought into contact with the hammer roller 14.

When the toe 6*b* is brought into contact with the regulating button 25, the regulating button 25 does not permit the toe 6*b* to move. However, the depressed key 30 forces the whippen 5 further to rotate. As a result, the reaction from the regulating button 25 causes the jack 6 to rotate in the clockwise direction. The leg 6*a* is moved in the hole 21, and exerts force on the hammer roller 14. Thus, the jack 6 escapes from the hammer roller 14, and the hammer 11 starts freely to rotate in the clockwise direction toward the string 19.

The hammer 18 is brought into collision with the string 19, and gives rise to the vibration of string 19. Thus, the acoustic piano tone is produced through the vibrations of string 19. The hammer 19 rebounds on the string 19, and is dropped in the downward direction. The hammer 11 is received by the back check 35.

When the pianist releases the depressed key 30, the released key 30 starts to travel toward the rest position. The released key 30 permits the whippen 5 to rotate in the clockwise direction, and the hammer roller 14 returns to the upper surface of the repetition lever 8 on the way to the rest position. As a result, the action unit ACT1 gets ready to respond to half-stroke key movements, in which the key 30 is repeatedly depressed before reaching the rest position and the end position.

When the released key 30 permits the whippen 5 to rotate in the clockwise direction, the toe 6*b* leaves the regulating button 25, and the repetition lever spring 12 causes the jack 6 to rotate in the counter clockwise direction about the pin 36. The released key 30 permits the damper DMP1 to descend due to the self-weight, and is brought into contact with the vibrating string 19 on the way of released key 30 to the rest position. As a result, the acoustic piano tone is decayed.

When the released key 30 reaches the rest position, the action unit ACT1, hammer 11, damper DMP1 returns to the respective rest positions shown in FIG. 1.

As described hereinbefore, the action units ACT1 have the complicated structure. Moreover, various regulating works are required for the repetition levers 8 through the repetition screw 34 and repetition lever button 15. However, the repetition levers 8 are indispensable component parts for the repetition through the half-stroke movements of keys 30. The complicated structure results in high production cost, and the regulating works make a large amount of time and labor consumed. Thus, there is a demand for an action unit with a simple repetition lever mechanism.

SUMMARY OF THE INVENTION

It is therefore an important object of the present invention to provide a musical instrument, which is equipped with simple action units.

It is also an important object of the present invention to provide the simple action unit for the keyboard musical instrument.

To accomplish the object, the present invention proposes to replace the repetition lever and repetition spring with an elastically deformable guide.

In accordance with one aspect of the present invention, there is provided a musical instrument for a player comprising a housing, plural manipulators supported by the housing and exposed to the player so that the player selectively moves the plural manipulators between rest positions and end portions for specifying tones, a driven linkwork having a stationary portion supported by the housing and a movable portion rotatable with respect to the stationary portion thereof and plural action units connected between the plural manipulators and the driven linkwork so as to transmit force applied through the plural manipulators to the driven linkwork, and each of the plural action units includes a whippen assembly rotatably supported by the housing and driven for rotation by the moved manipulators, a jack mechanism having a stationary portion supported by the housing and a movable portion rotatably supported by the whippen assembly and brought into contact with the stationary portion thereof in the rotation of the whippen assembly driven by the manipulator moved toward the rest position for escaping from the movable portion of the driven linkwork and a repetition mechanism having an elastically deformable guide supported by the whippen assembly, deformed by the stationary portion of the driven linkwork in the rotation of the whippen assembly driven by the manipulator on the way to the end position so as to permit the movable portion of the jack mechanism to drive the movable portion of the driven linkwork for rotation through the escape and recovered from the deformation in the rotation driven by the manipulator on the way to the rest position so as to be brought into contact with the movable portion of the driven linkwork for repetition of manipulation on the manipulator.

In accordance with another aspect of the present invention, there is provided an action unit incorporated in a musical instrument together with other action units, plural manipulators and a driven linkwork, and the action unit comprises a whippen assembly rotatably supported by a housing of the musical instrument and driven for rotation by one of the manipulators moved between a rest position and an end position, a jack mechanism having a stationary portion supported by the housing and a movable portion rotatably supported by the whippen assembly and brought into contact with the stationary portion thereof in the rotation of the whippen assembly driven by the aforesaid one of the manipulators moved toward the rest position for escaping from a movable portion of the driven linkwork and a repetition mechanism having an elastically deformable guide supported by the whippen assembly, deformed by a stationary portion of the driven linkwork in the rotation of the whippen assembly driven by the aforesaid one of the manipulators on the way to the end position so as to permit the movable portion of the jack mechanism to drive the movable portion of the driven linkwork for rotation through the escape and recovered from the deformation in the rotation driven by the aforesaid one of the manipulators on the way to the rest position so as to be brought into contact with the movable portion of the driven linkwork for repetition of manipulation on the aforesaid one of the manipulators.

BRIEF DESCRIPTION OF THE DRAWINGS

The features and advantages of the keyboard musical instrument and action unit will be more clearly understood from the following description taken in conjunction with the accompanying drawings, in which.

DESCRIPTION OF THE PREFERRED EMBODIMENTS

Figure 1:
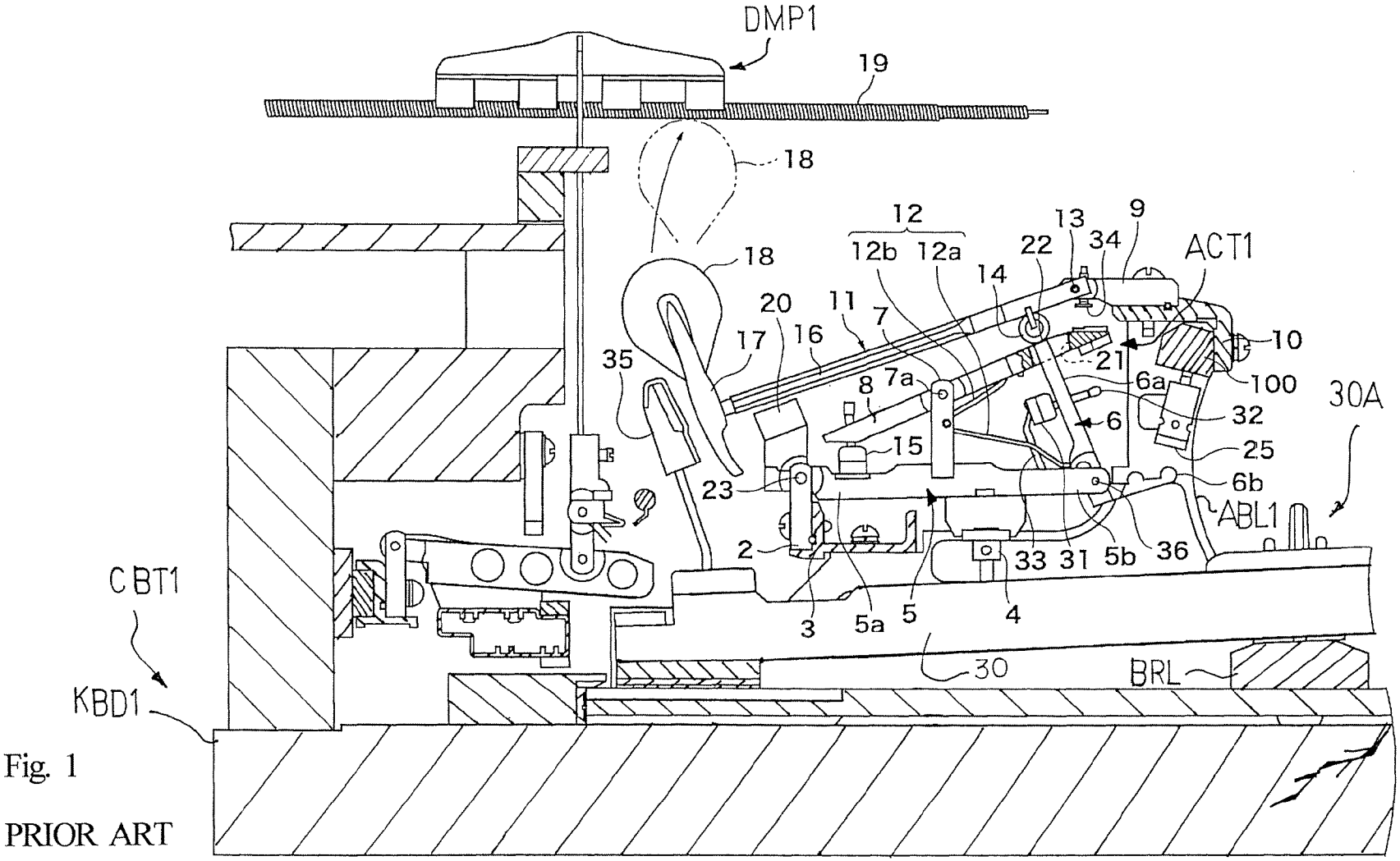
Fig. 1 PRIOR ART
FIG. 1 is a cross sectional side view showing the structure of the prior art grand piano.

A musical instrument embodying the present invention is used by a player for a music performance, and largely comprises a housing, plural manipulators, a driven linkwork and plural action units. The driven linkwork is adapted to generate tones, to give a unique tactile impression to the player through reaction thereof or to achieve both functions. Accordingly, the structure of driven linkwork is optimized depending upon the purpose.

The plural manipulators are supported by the housing, and are exposed to the player. The player selectively moves the plural manipulators between rest positions and end portions for specifying tones. The driven linkwork has a stationary portion and a movable portion. The stationary portion is supported by the housing, and the movable portion is rotatable with respect to the stationary portion. The plural action units are connected between the plural manipulators and the driven linkwork, and transmits force applied through the plural manipulators to the driven linkwork. Thus, the driven linkwork is actuated by the plural manipulators through the action units.

Each of the plural action units includes a whippen assembly, a jack mechanism and a repetition mechanism. The whippen assembly is rotatably supported by the housing, and is driven for rotation by the moved manipulators. The jack mechanism has a stationary portion and a movable portion. The stationary portion is supported by the housing. On the other hand, the movable portion is rotatably supported by the whippen assembly.

While the associated manipulator, which is moving toward the rest position, is driving the whippen assembly to rotate, the movable portion of jack mechanism is getting closer and closer to the stationary portion of jack mechanism. When the movable portion is brought into contact with the stationary portion, the movable portion of jack mechanism escapes from the movable portion of the driven linkwork, and makes the driven linkwork achieve the given task.

The repetition mechanism aims at offering assistance in repetition of manipulation on the manipulator, and has an elastically deformable guide. The elastically deformable guide is supported by the whippen assembly.

While the whippen assembly is being driven by the manipulator traveling toward the end position, the elastically deformable guide is getting closer and closer toward the stationary portion of driving linkwork. When the elastically deformable guide is brought into contact with the stationary portion of driven linkwork, the elastically deformable guide starts gradually to be deformed by the stationary portion of the driven linkwork, and makes the movable portion of jack mechanism get ready for the escape. When the movable portion of jack mechanism escapes from the movable portion of driven linkwork, the driven linkwork is actuated, and achieves the given task through the rotation of movable portion thereof.

When the manipulator moves toward the rest position, the whippen assembly starts to rotate in the opposite direction. Then, the elastically deformable guide starts to recover itself from the deformation, and the movable portion of jack mechanism starts to return. The elastically deformable guide is brought into contact with the movable portion of driven linkwork, again, on the way of manipulator to the rest position so as to allow the player repeatedly to manipulate the manipulator.

As will be appreciated from the foregoing description, the elastically deformable guide makes it possible repeatedly to manipulate the manipulator. Although the prior art action unit requires the repetition lever and repetition spring for the repetition, the elastically deformable guide serves as both of the repetition lever and repetition spring. Thus, the action unit embodying the present invention is simplified, and is constructed from the component less than those of the prior art action unit.

First Embodiment

Figure 2:
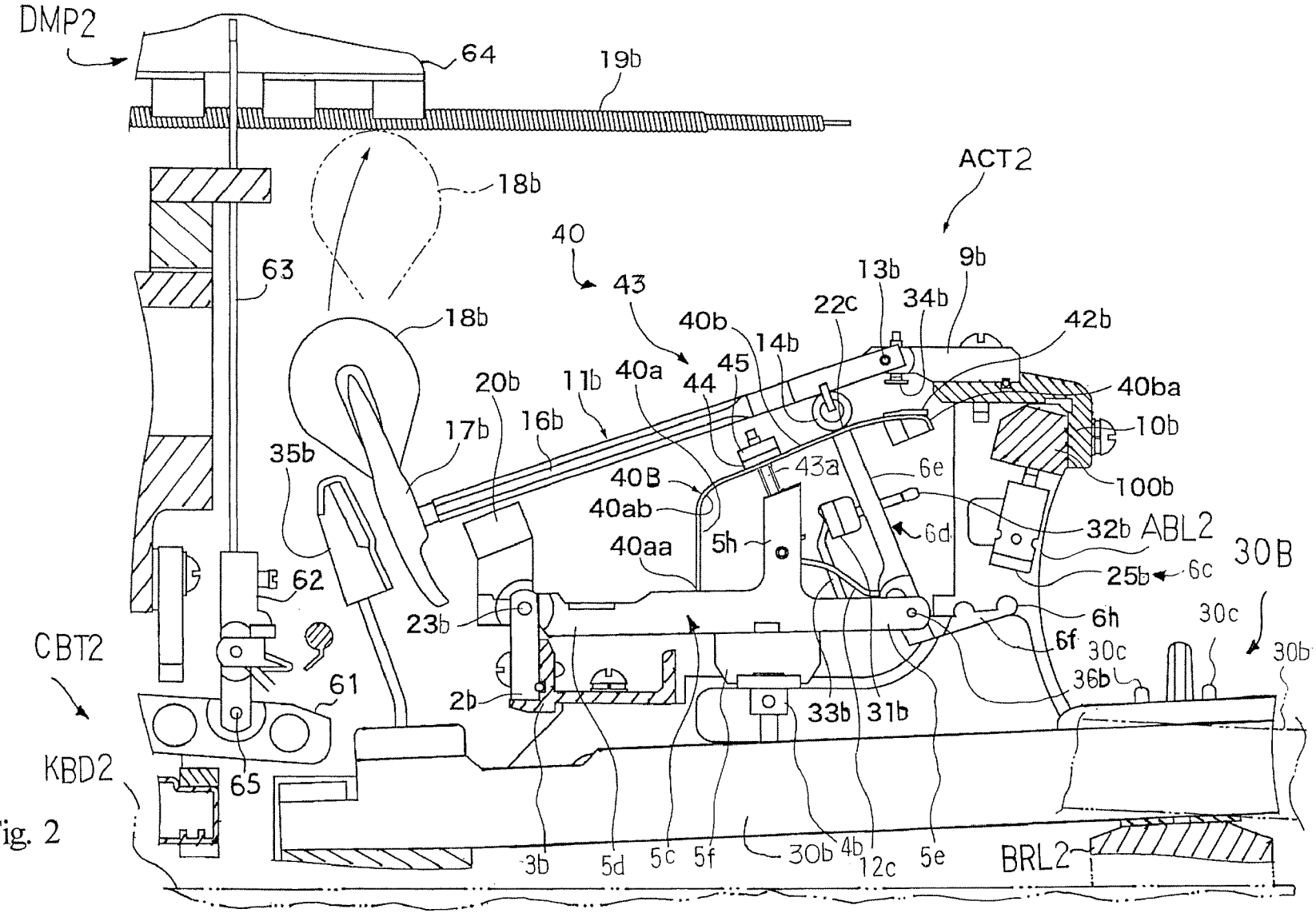
FIG. 2 is a cross sectional side view showing the structure of a grand piano of the present invention.

Referring to FIG. 2 of the drawings, a grand piano embodying the present invention largely comprises a keyboard 30B, action units ACT2, hammer assemblies 11*b*, dampers DMP2, strings 19*b* and piano cabinet CBT2. The piano cabinet CBT has a horizontal outline like a wing, and is supported by legs (not shown). An inner space is defined in the piano cabinet CBT2, and a key bed KBT2 defines the bottom of inner space. The keyboard 30B is mounted on the key bed KBD2, and the action units ACT2, hammer assemblies 11*b*, dampers DMP2 and strings 19*b* are installed in the inner space.

The keyboard 30B includes plural keys 30*b*, a balance rail BRL2, balance key pins 30*c* and capstan screws 4*b*. The balance rail BRL2 extends over the key bed KBD2 in the lateral direction, and the keys 30*b* extend over the balance rail BRL2 in the fore-and-aft direction so as independently to pitch up and down. The balance key pins 30*c* project from the balance rail BRL2, and offer fulcrums to the keys 30*b*. The capstan screws 4*b* are partially implanted into the rear portions of keys 30*b*, and project from the upper surfaces of keys 30*b*. The capstan screws 4*b* are held in contact with the action units ACT2, respectively, and the movements of keys 30*b* are transmitted to the associated action units ACT2 through the capstan screws 4*b*. Parts of the keys 30*b*, which are closer to the associated dampers DMP2 than the balance key pins 30*c*, are referred to as "rear portions", and remaining parts are referred to as "front portions". Thus, the balance key pins 30*c* are found at the boundaries between the front portions and the rear portions.

When a pianist does not exert any finger force on the front portions of keys 30*b*, the action units ACT2 exert self-weight on the rear portions of keys 30*b*, and the front portions of keys 30*b* are raised over the key bed KBD2. In other words, the keys 30*b* stay at rest positions, respectively.

When the pianist depresses the keys 30*b*, the front portions of depressed keys 30*b* are sunk, and the rear portions of keys 30*b* are raised together with the capstan screws 4*b*. As a result, the force is transmitted to the action units ACT2 through the capstan screws 4*b*. When the keys 30*b* reach the lower dead points, the depressed keys 30*b* are found at end positions.

The action units ACT2 are respectively provided in association with the keys 30*b*, and are provided over the rear portions of keys 30*b*. Plural action brackets ABL2 are provided over the key bed KBD2 at intervals in the lateral direction. A support rail 3*b* extends over the rear portions of keys 30*b* in the lateral direction, and is connected to the rear portions of action brackets ABL2. A hammer shank rail 10*b* extends over the rear portions of keys 30*b* in the lateral direction, and is connected to the front portions of action brackets ABL2. The action units ACT2 are partially supported by the support rail 3*b* and hammer shank rail 10*b*. Thus, the action units ACT2 are provided over the rear portions of keys 30*b*.

The action units ACT2 are similar in structure to one another. Each of the action units ACT2 is broken down into a whippen assembly 5*c*, jack mechanism 6*c* and a repetition mechanism 40. The force is transmitted from the key 30*b* to the whippen assembly 5*c* through the capstan screw 4*b*, and the whippen assembly 5*c* gives rise to escape between the jack mechanism 6*c* and the hammer assembly 11*b*. Thus, the whippen assembly 5*c* cooperates with the jack mechanism 6*c* for the escape. On the other hand, the repetition mechanism 40 makes the jack mechanism 6*c* get ready to escape from the hammer assembly 11*b* on the way of released key 30*b* to the rest position.

The whippen assembly 5*c* includes a support flange 2*b*, a rear portion 5*d*, a front portion 5*e*, a whippen heel 5*f* and a center projection 5*h*. The rear portion 5*d* and front portion 5*e* straightly extend in the fore-and-aft direction, and the whippen heel 5*f* projects from the rear portion 5*d* and front portion 5*e* in the downward direction. On the other hand, the center projection 5*h* extends from the boundary portion between the rear portion 5*d* and the front portion 5*e* in the upward direction. The capstan screw 4*b* is held in contact with the lower surface of whippen heel 5*f*.

The support flange 2*b* is bolted to the support rail 3*b*, and the rear portion 5*d* is connected to the support flange 2*b* by means of a pin 23*b*. For this reason, the whippen assembly 5*c* is rotatable about the pin 23*b*. While a pianist is depressing the front portion of key 30*b*, the front portion of depressed key 30*b* is sunk, and the rear portion of depressed key 30*b* rises. The capstan screw 4*b* of depressed key 30*b* pushes the whippen assembly 5*c* through the capstan screw 4*b*, and gives rise to rotation of the whippen assembly 5*c* in the counter clockwise direction. On the other hand, while the pianist is releasing the depressed key 30*b*, the rear portion of released key 30*b* is sunk due to the self-weight of action unit ACT2, and the front portion of released key 30*b* rises. Thus, the released key 30*b* gives rise to rotation of the whippen assembly 5*c* in the clockwise direction.

The jack mechanism 6*c* includes a jack 6*d*, a jack spring 12*c*, a regulating button 25*b*, a jack button 31*b*, a jack button screw 32*b* and a jack stop spoon 33*b*. The jack 6*d* has a L-letter shape, and is connected to the front portion 5*e* of whippen assembly 5*c* by means of a pin 36*b*. For this reason, the jack 6*d* is rotatable about the pin 36*b*. The jack 6*d* has a leg portion 6*e* and a foot portion 6*f*, and a toe 6*h* is formed on the foot portion 6*f*. The leg portion 6*e* upwardly extends, and the foot portion 6*f* extends in the frontward direction. The leg portion 6*e* has an upper surface 22*c*, and the jack 6*d* exerts force on the associated hammer assembly 11*b* through the upper surface 22*c*.

A regulating rail 100*b* extends in the lateral direction, and is bolted to the shank rail 10*b*. The regulating button 25*b* is hung from the regulating rail 100*b*, and is opposed to the toe 6*h*. The regulating button 25*b* is projectable and retractable through rotation thereof so that the distance between from the toe 6*h* is regulable. The jack spring 12*c* is provided between the center projection 5*h* and the jack 6*d*, and urges the jack 6*d* in the clockwise direction at all times. For this reason, while the key 30*b* is staying at the rest position, the toe 6*h* is spaced from the regulating button 25*b*. In this instance, the jack spring 12*c* is implemented by a metallic wire.

The jack stop spoon 33*b* is partially implanted into the front portion 5*e* of whippen assembly 5*c* at the back of the leg portion 6*e*, and projects from the upper surface of front portion 5*e* in the upward direction. The jack button screw 32*b* projects through the leg portion 6*e* in the rearward direction, and the jack button 31*b* is secured to the rear end portion of jack button screw 32*b*. The jack stop spoon 33*b* and jack button 31*b* do not permit the jack 6*d* to rotate in the counter clockwise direction, and the jack button screw 32*b* makes it possible to regulate the angle between the leg portion 6*e* and the rear portion 5*e* to an optimum value.

The repetition mechanism 40 includes an elastic guide plate 40B, a drop screw 34*b*, a repetition skin 42*b* and a load applier 43. The drop screw 34*b* is held in threaded engagement with the hammer shank flange 9*b*, and projects from the lower surface of hammer shank flange 9*b* in the downward direction. On the other hand, the repetition skin 42*b* is adhered to the upper surface of a leading end sub-portion 40*ba* of elastic guide plate 40B, and is opposed to the drop screw 34*b*.

The elastic guide plate 40B has elasticity, and is made of metal, alloy or synthetic resin. In this instance, the elastic guide plate 40B is formed from a leaf spring. The elastic guide plate 40B has a fixed end portion 40*a* and a free end portion 40*b*, and the thickness of elastic guide plate 40B is fallen within the range from 0.1 mm to 1.0 mm.

The fixed end portion 40*a* has a boss sub-portion 40*aa*, which is embedded in the rear portion 5*d* of whippen assembly 5*c*, and a curved sub-portion 40*ab*. The boss sub-portion 40*aa* is upright to the upper surface of the rear portion 5*d* of whippen assembly 5*c*, and is continued to the curved subportion 40*ab*.

Figure 3:
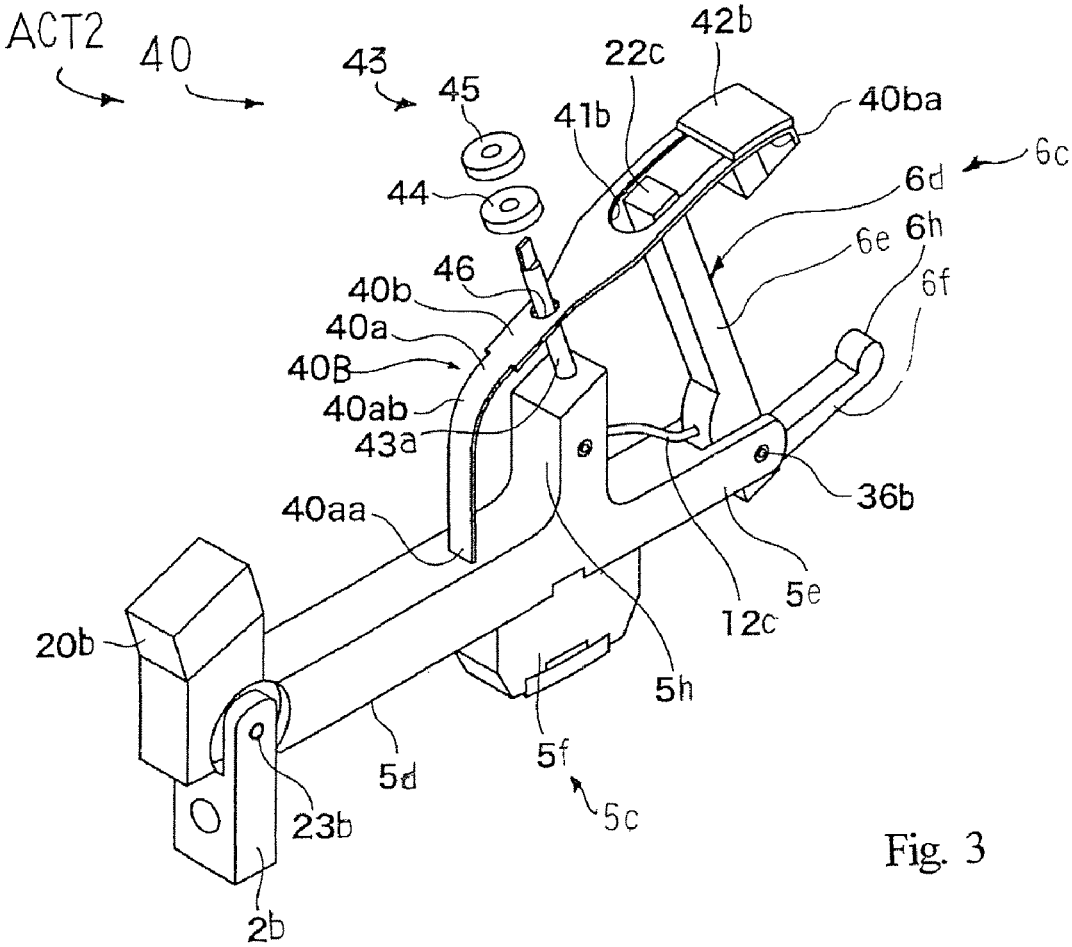
FIG. 3 is a perspective view showing an action unit of the grand piano.
Figure 4:
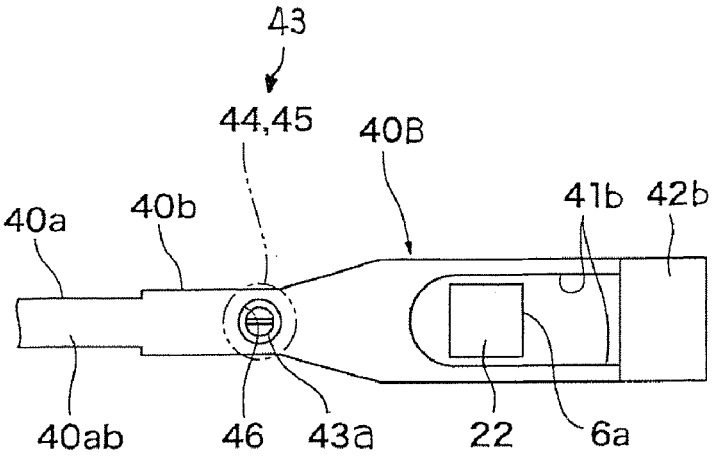
FIG. 4 is a plane view showing an elastic plate incorporated in the action unit.

The fixed end portion 40*a* is narrower than the free end portion 40*b* as shown in FIGS. 3 and 4, and has the geometrical moment of inertia less than that of the free end portion 40*b*. The free end portion 40*b* extends over the rear end portion 5*e* of whippen assembly 5*c*. The free end portion 40*b* is formed with a long hole 41*b* and a small circular hole 46, and the long hole 41*b* and small circular hole 46 are assigned to the leg portion 6*e* and the load applier 43, respectively. The maximum width of free end portion 40*b* is fallen within the range between 10 millimeters and 11 millimeters, and permits the hammer roller 14*b* smoothly to rotate thereon in stable. The width of long hole 41*b* is greater than the width of leg portion 6*e*, and the length of long hole 41*b* is greater than the travel range of the upper surface of leg portion 6*e*. The leg portion 6*e* is loosely inserted into the long hole 41*b*, and is movable in the long hole 41*b* without any friction on the inner surface defining the long hole 41*b*.

The free end portion 40*b* is not connected to any other component part so as to be flexural. In other words, the elastic guide plate 40B is supported by the whippen assembly 5*c* in the cantilever fashion. If the load applier 43 does not exert any force on the free end portion 40*b*, the free end portion 40*b* is spaced from the upper surface 22*c* in the upward direction.

The load applier 43 includes a threaded stem 43*a*, a felt punching 44 and a nut 45. The threaded stem 43*a* is implanted into the center projection 5*h*, and extends from the upper surface of center projection 5*h* in the upward direction. The threaded stem 43*a* is rearwardly inclined, and the reading end portion of threaded stem 43*a* passes through the small circular hole 46. The felt punching passes through the leading end portion of threaded stem 43*a*, and the nut 45 is driven into the leading end portion. The nut 45 is tightened, and exerts force on the free end portion 40*b* through the felt punching 44. The free end portion 40*b* is pressed in the downward direction. Thus, the load applier 43 makes the free end portion 40*b* warped, and makes the upper surface of free end portion 40*b* almost coplanar with the upper surface 22*c* of leg portion 6*e*. If force is exerted on the free end portion 40*b*, the upper surface of which is almost coplanar with the upper surface, the free end portion 40*b* is further warped toward the whippen assembly 5*c*, and the leg portion 6*e* projects over the upper surface of free end portion 40*b*.

While the keys 30*b* are staying at the rest positions, the whippen assemblies 5*c* are maintained at the rest positions shown in FIG. 2, toes 6*h* are spaced from the regulating buttons 25*b*, the repetition skins 42*b* are spaced from the drop screws 34*b*, and the hammer rollers 14*b* are rest on the upper surface of free end portions 40*b*.

Turning back to FIG. 2, each of the action units further includes a hammer shank stop felt 20*b* and a back check 35*b*. The hammer shank stop felt 20*b* is secured to the rearmost end portion of whippen assembly 5*c*. The back check 35*b* is partially implanted in the rear portion of associated key 30*b*, and upwardly projects from the rear portion of key 30*b*. The hammer assembly 11*b* is received by the back check 35*b* after rebound on the string 19*b*, and is separated from the back check 35*b* after release of the depressed key 30*b*. The hammer shank stop felt 20*b* prevents the hammer assembly 11*b* from descent after the separation from the back check 35*b*.

The hammer assemblies 11*b* are respectively provided in association with the action units ACT2. Each of the hammer assemblies 11*b* includes a hammer shank flange 9*b*, a hammer roller 14*b*, a hammer shank 16*b*, a hammer wood 17*b* and a hammer felt 18*b*. The hammer shank flange 9*b* is bolted to the hammer shank rail 10*b*, and the hammer shank 16*b* is rotatably connected to the hammer shank flange 9*b* by means of a pin 13*b*. The hammer shank 16*b* extends over the elastic guide plate 40B from the hammer shank flange 9*b* in the rearward direction. The hammer wood 17*b* is secured to the leading end of hammer shank 16*b*, and the hammer felt 18*b* is secured to the hammer wood 17*b*.

The hammer roller 14*b* is rotatably supported by the hammer shank 16*b*, and is hung from the hammer shank 16*b*. The hammer roller 14*b* is rest on the upper surface of the elastic guide plate 40B, and is movable on the upper surface of the free end portion 40*b* and the upper surface 22*c* of leg portion 6*e* through rotation thereof. When the jack 6*d* escapes from the hammer assembly 11*b*, the leg 6*e* kicks the hammer roller 14*b*, and gives rise to the rotation of hammer assembly 11*b*.

The strings 19*b* are provided in association with the hammer assemblies 11*b*, respectively, and are stretched over the hammer assemblies 11*b*. The strings 19*b* are different in size from one another so that the strings 19*b* produce the acoustic piano tones at different pitch through vibrations thereof. While the keys 30*b* are staying at the rest positions, the hammer rollers 14*b* are rest on the upper surface of the free end portions 40*b*, and the hammer assemblies 11*b* are spaced from the associated strings 19*b*. When the jacks escape from the hammer assemblies 11*b*, the hammer assemblies 11*b* start the rotation toward the strings 19*b*. The hammer assemblies 11*b* are brought into collision with the associated strings 11*b*, and rebound on the strings 11*b*. Then, the strings 19*b* vibrate for producing the acoustic piano tones.

The dampers DMP2 are respectively provided in association with the keys 30*b* at the back of the keys 30*b*. The dampers DMP2 are further associated with the strings 19*b*, respectively. The dampers DMP2 prohibit the strings 19*b* from resonance with one another, and permit the strings 19*b* to vibrate for producing the acoustic piano tones. Each of the dampers DMP2 includes a damper lever 61, a damper block 62, a damper wire 63 and a damper head 64.

A damper rail (not shown) extends in the lateral direction. The damper lever 61 is rotatably connected to the damper rail, and extends from the damper rail in the frontward direction. The leading end portion of damper lever 61 reaches the space over the rearmost end portion of associated key 30*b*. The damper block 62 is rotatably connected to the damper lever 61 by means of a pin 65, and extends from the damper lever 61 in the upward direction. The damper wire 63 is partially implanted in the damper block 62, and extends from the damper block 62 in the upward direction. The damper head 64 is secured to the upper end portion of damper wire 63.

While the associated key 30*b* is staying at the rest position, the damper lever 61 is spaced from the rearmost portion of key 30*b*, and the damper head 64 is held in contact with the associated string 19*b*. In this situation, even if another string 19*b* vibrates, the damper head 64 does not permit the string 19*b* to resonate with another string 19*b*.

When the pianist depresses the front portion of key 30*b*, the rear portion of key 30*b* starts to rise. The rearmost portion of key 30*b* is brought into contact with the lower surface of damper lever 61 on the way toward the end position so as to give rise to the rotation of damper lever 61 in the counter clockwise direction. The rotated damper lever 61 gives rise to the upward movement of damper wire 63, and the damper wire 63 pushes up the damper head 64. Thus, the damper head 64 is spaced from the string 19*b*. As a result, the string 19*b* gets ready to vibrate.

The hammer assembly 11*b* is brought into collision with the string 19*b*, and gives rise to the vibrations of string 19*b*. The pianist releases the depressed key 30*b*, and the rear portion is sunk. The released key 30*b* permit the damper lever 61 to descend so that the damper lever 61 rotates in the clockwise direction. Accordingly, the damper block 62, damper wire 63 and damper head 64 are moved in the downward direction. The damper head 64 is brought into contact with the vibrating string 19*b* on the way of released key 30*b* toward the rest position, and the vibrations are decayed.

When a pianist depresses one of the keys 30*b*, the front portion of depressed key 30*b* starts the downward movement toward the end position, and the rear portion of depressed key 30*b* starts to push up the whippen assembly 5*c* so as to give rise to the rotation of whippen assembly 5*c* about the pin 23*b* in the counter clockwise direction.

The rearmost portion of depressed key 30*b* gets closer and closer to the damper lever 61, and is brought into contact with the lower surface of damper lever 61. The rearmost portion of depressed key 30*b* exerts the force on the lower surface of damper lever 61 in the upward direction, and causes the damper head 64 to leave the string 19*b*. As a result, the string 19*b* gets ready to vibrate.

The repetition mechanism 40 and jack 6*c* are rotated about the pin 23*b* together with the whippen assembly 5*c*, and the hammer roller 14*b*, which is moved on the upper surface of elastic guide plate 40B and the upper surface 22*c* of leg portion 6*e*, is forced to rotate about the pin 13*b*.

The repetition skin 42*b* is brought into contact with the drop screw 34*b* so that the drop screw 34*b* prohibits the free end portion 40*b* from the rotation together with the whippen assembly 5*c*. Since the depressed key 30*b* makes the whippen assembly 5*c* further rotate about the pin 23*b*, the reaction from the drop screw 34*b* gives rise to the elastic deformation of elastic guide plate 40B, and the leg portion 6*e* projects over the upper surface of free end portion 40*b*. Although the relation between the hammer assembly 11*b* and the action unit ACT2 is differently varied depending upon the fingering of pianist, the hammer roller 14*b* is usually moved onto the upper surface 22*c* of leg portion 6*e*, and the jack 6*c* pushes the hammer roller 14*b* so as continuously give rise to the rotation of hammer assembly 11*b* about the pin 13*b*.

Subsequently, the toe 6*h* is brought into contact with the regulating button 25*b*. The regulating button 25*b* does not permit the toe 6*h* further to rotate together with the whippen assembly 5*c* so that the rotating whippen assembly 5*c* gives rise to the rotation of jack 6*c* about the pin 36*b* in the clockwise direction. The leg portion 6*e* inclines in the long hole 41*b*, and the jack 6*c* escapes from the hammer assembly 11*b*. While the jack 6*c* is escaping from the hammer assembly 11*b*, the leg portion 6*e* kicks the hammer roller 14*b* through the upper surface 22*c*. As a result, the hammer assembly starts the free rotation toward the string 19*b*.

The hammer assembly 11*b* is brought into collision with the string 19*b* at the end of free rotation, and rebounds on the string 19*b*. The string 19*b* vibrates, and the acoustic piano tone is produced through the vibrations of string 11*b*.

Upon rebounding on the string 19*b*, the hammer assembly 11*b* is dropped toward the action unit ACT2. Since the depressed key 30*b* raises the rear portion thereof together with the back check 35*b*, the hammer wood 17*b* is landed on the back check 35*b*. While the pianist keeps the depressed key 30*b* at the end position, the hammer assembly 11*b* is rest on the back check 35*b*. When the pianist releases the depressed key 30*b*, the released key 30*b* starts to travel toward the end portion, and the hammer assembly 11*b* leaves the back check 35*b*.

The released key 30*b* permits the whippen assembly 5*c* to rotate about the pin 23*b* in the clockwise direction, and the repetition skin 42*b* is spaced from the drop screw 34*b*. The elastic guide plate 40B makes the free end portion 40*b* to return from the deformed state to the initial state by virtue of the elasticity thereof until the felt punching free end portion 40*b* is brought into contact with the felt punching 44. The leg portion 6*e* is retracted into the long hole 22*c*, and the hammer roller 14*b* is brought into contact with the upper surface 22*c* and the upper surface of free end portion 40*b*.

The released key 30*b* further permits the jack 6*c* to rotate about the pin 23*b* in the clockwise direction together with the whippen assembly 5*c*. The toe 6*h* leaves the regulating button 25*b*, and the jack 6*c* rotates in the counter clockwise direction about the pin 36*b*. For this reason, while the leg portion 6*e* is being retracted into the long hole 22*c*, the leg portion 6*e* is moved in the rearward direction in the long hole 22*c*, and returns to the initial position thereof. Thus, the jack mechanism 6*c* and repetition mechanism 40 get ready to give rise to the free rotation of hammer assembly 11*b* on the way of released key 30*b* to the rest position.

If the pianist depresses the key 30*b* on the way to the rest position, again, the jack 6*c* escapes from the hammer assembly 11*b* at the timing to bring the toe 6*h* into contact with the regulating button 25*b*, and the leg portion 6*e* kicks the hammer roller 14*b* so as to give rise to the free rotation toward the string 19*b*. Thus, the repetition mechanism 40 permits the pianist repeatedly to produce the acoustic tones through the repetition.

When the repetition mechanism 40 is compared with the prior art repetition mechanism shown in FIG. 1, it is understood that the elastic guide plate 40B behaves as similar to both of the repetition lever 8 and arm 12*b* of repetition lever spring 12. It is further understood that the behavior of load applier 43 is similar to that of the repetition lever button 15. The replacement of repetition lever 8 and repetition spring 12 with the elastic guide plate 40B makes it possible to simplify the structure of repetition mechanism 40 and reduce the production cost of action unit ACT2.

Although it is impossible to fit the repetition lever button 15 to the elastic guide plate 40B due to the cantilever structure, the load applier 43 makes it possible to regulate the elastic guide plate 40B to the appropriate initial position. For this reason, the repetition mechanism 40 permits the pianist to play music tune through the high-speed repetition.

Second Embodiment

Figure 5:
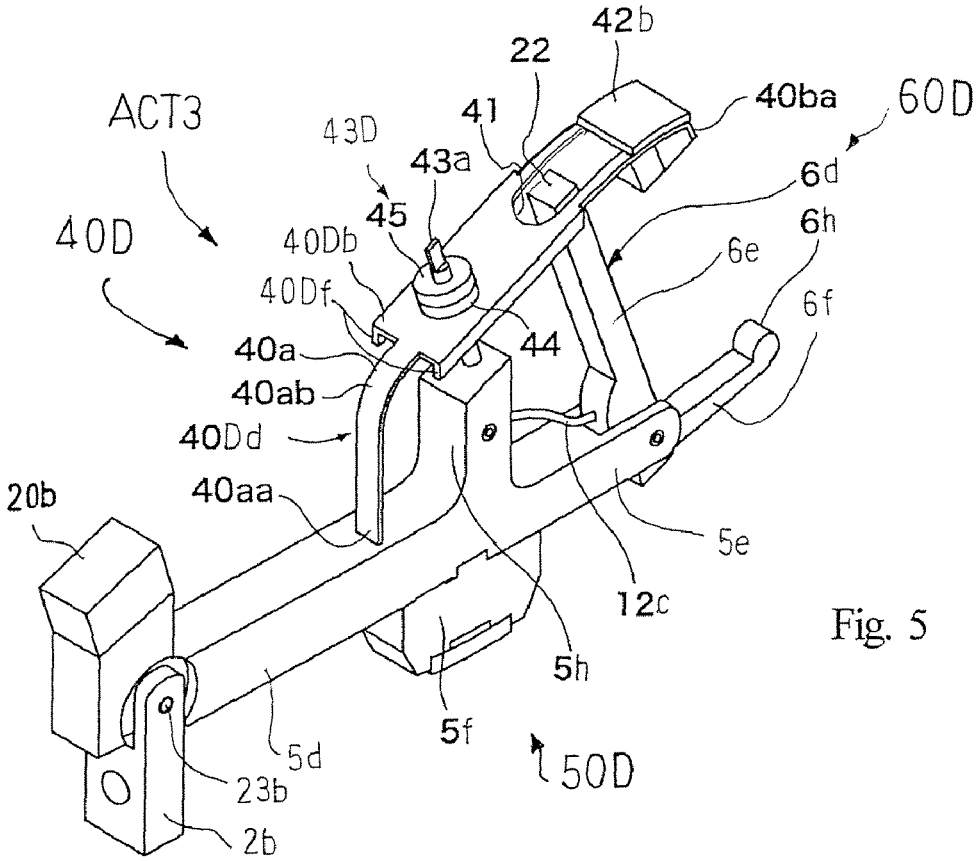
FIG. 5 is a perspective view showing an action unit incorporated in another keyboard musical instrument of the present invention.

Turning to FIG. 5, an action unit ACT3 forms a part of a keyboard musical instrument together with other action units, a keyboard, hammer assemblies, strings, dampers and a cabinet. The keyboard, hammer assemblies, strings, dampers and cabinet are similar to the keyboard 30B, hammer assemblies 11*b*, strings 19*b*, dampers DMP2 and piano cabinet CBT2, and, for this reason, are labeled with references designating the corresponding component parts of grand piano without detailed description.

The action unit ACT3 includes a whippen assembly 50D, a jack mechanism 60D and a repetition mechanism 40D. The whippen assembly 50D and jack mechanism 60D are similar to the whippen assembly 5*c* and jack mechanism 6*c*, respectively, and, for this reason, components parts of whippen assembly 50D and the component parts of jack mechanism 60D are hereinafter labeled with references designating the corresponding component parts of whippen assembly 5*c* and the component parts of jack mechanism 6*c*.

Description is focused on the repetition mechanism 40D. The repetition mechanism 40D includes an elastic guide plate 40Dd, a drop screw (not shown), a repetition skin (not shown) and a load applier 43D. The drop screw, repetition skin and load applier 43D are similar to the drop screw 34*b*, repetition skin 42*b* and load applier 43. For this reason, detailed description on the drop screw, repetition skin and load applier 43D is omitted for avoiding repetition.

The elastic guide plate 40Dd includes a fixed end portion 40*a*, which has a boss sub-portion 40*aa* and a curved sub-portion 40*ab*, and a free end portion 40Db as similar to the elastic guide plate 40B. The elastic guide plate 40Dd further has flange portions 40Df, and the flange 40Dd projects from both sides of a rear sub-potion of the free end portion 40Db in the downward direction. The flange portions 40Df make the geometrical moment of inertia of rear sub-portion of free end portion 40Db enlarged so that the rear sub-portion of free end portion 40Db is hardly bent. When the force is exerted on the rear sub-portion of free end portion 40Db by means of the load applier 43D, the rear sub-portion of free end portion 40Db keeps itself straight, and the bending moment is exerted on the fixed end portion 40*a*, and the fixed end portion 40*a* is widely bent. For this reason, the worker easily makes the upper surface of free end portion 40Db coplanar with the upper surface 22 of leg portion 6*e*.

Thus, the action unit ACT3 achieves all the advantages of the action unit ACT2, and further has the advantages in the easiness of regulating work and in the rapid return.

Third Embodiment

Figure 6:
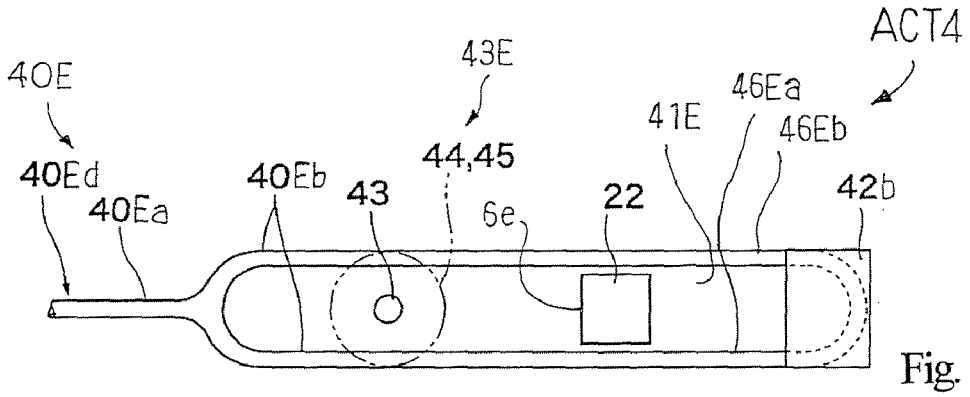
FIG. 6 is a plane view showing an elastic guide plate of an action unit incorporated in yet another keyboard musical instrument of the present invention.

Turning to FIG. 6, an action unit ACT4 embodying the present invention has an elastic guide member 40Ed. The action unit ACT4 is incorporated in a keyboard musical instrument.

The action unit ACT4 includes a whippen assembly (not shown), a jack mechanism (not shown) and a repetition mechanism 40E. The whippen assembly and jack mechanism are similar to the whippen assembly 5*c* and jack mechanism 6*c*, respectively, and, for this reason, no further description is hereinafter incorporated for the sake of simplicity.

The repetition mechanism 40E includes the elastic guide member 40Ed, a drop screw (not shown), a repetition skin (not shown) and a load applier 43E. The drop screw, repetition skin and load applier 43E are similar to the drop screw 34*b*, repetition skin 42*b* and load applier 43. For this reason, detailed description on the drop screw, repetition skin and load applier 43E is omitted for avoiding repetition.

The elastic guide member 40Ed is implemented by a framework, and includes a fixed end portion 40Ea and a free end portion 40Eb. The fixed end portion 40Ea is formed from wire rod. The fixed end portion 40Ea is partially implanted into the rear portion of whippen assembly, and is bent as similar to the fixed end portion 40*a*. The fixed end portion 40Ea is merged into the free end portion 40Eb. The free end portion 40Eb is also formed the wire rod, and the free end portion 40Eb has a semicircular rear end subportion, a semicircular front end portion and two straight portions 46Ea and 46Eb. The straight portions 46Ea and 46Eb are connected between the semi-circular front end portion and the semicircular rear end portion, and are spaced from each other. As a result, a gap 41E takes place. The gap 41E is narrower than the width of hammer roller so that the hammer roller rotates on the elastic guide member 40E. The upper surface 22 of leg portion of jack 6*e* is exposed to the gap 41E. The leg portion 6*e* is projectable over the free end portion 40Eb, and is movable without any friction with the straight portions 46Ea and 46Eb.

The action unit ACT4 achieves all the advantages of the action unit ACT2. Moreover, the elastic guide member 40E is simpler than the elastic guide plate 40B so that the production cost of action unit ACT4 is lower than that of the action unit ACT2 is.

Fourth Embodiment

Figure 7:
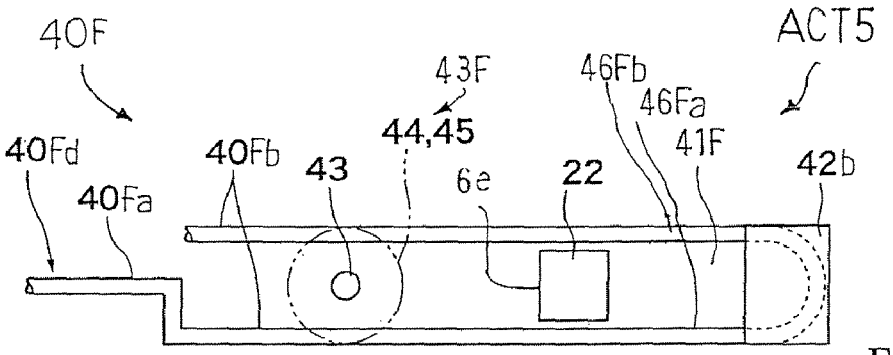
FIG. 7 is a plane view showing an elastic guide plate of an action unit incorporated in still another keyboard musical instrument of the present invention.

Turning to FIG. 7, an action unit ACT5 embodying the present invention has an elastic guide member 40Fd. The action unit ACT5 is incorporated in a keyboard musical instrument.

The action unit ACT5 includes a whippen assembly (not shown), a jack mechanism (not shown) and a repetition mechanism 40F. The whippen assembly and jack mechanism are similar to the whippen assembly 5*c* and jack mechanism 6*c*, respectively, and, for this reason, no further description is hereinafter incorporated for the sake of simplicity.

The repetition mechanism 40F includes the elastic guide member 40Fd, a drop screw (not shown), a repetition skin (not shown) and a load applier 43F. The drop screw, repetition skin and load applier 43F are similar to the drop screw 34*b*, repetition skin 42*b* and load applier 43. For this reason, detailed description on the drop screw, repetition skin and load applier 43F is omitted for avoiding repetition.

The elastic guide member 40Fd is also implemented by a rod, and is broken down into a fixed end portion 40Fa and a free end portion 40Fb. However, the free end portion 40Fb is not closed. The fixed end portion 40Fa is twice bent, and is merged into the free end portion 40Fb. The free end portion 40Fb has two straight portions 46Fa and 46Fb and a front semicircular portion. The straight portion 46*a* is connected at one end to the fixed end portion 40Fa and at the other end to one end of the front semicircular portion. The other end of front semicircular portion is connected to the other straight portion 46Fb. Although the other end portion of straight portion 46Fb reaches the fixed end portion 40Fd, it is spaced from the fixed end portion 40Fd.

The elastic guide member 40F is simply bent and curved so that the manufacturer easily machines the guide member easier than the elastic guide member 40E.

The action unit ACT5 achieves all the advantages of the action unit ACT2.

Fifth Embodiment

Figure 8:
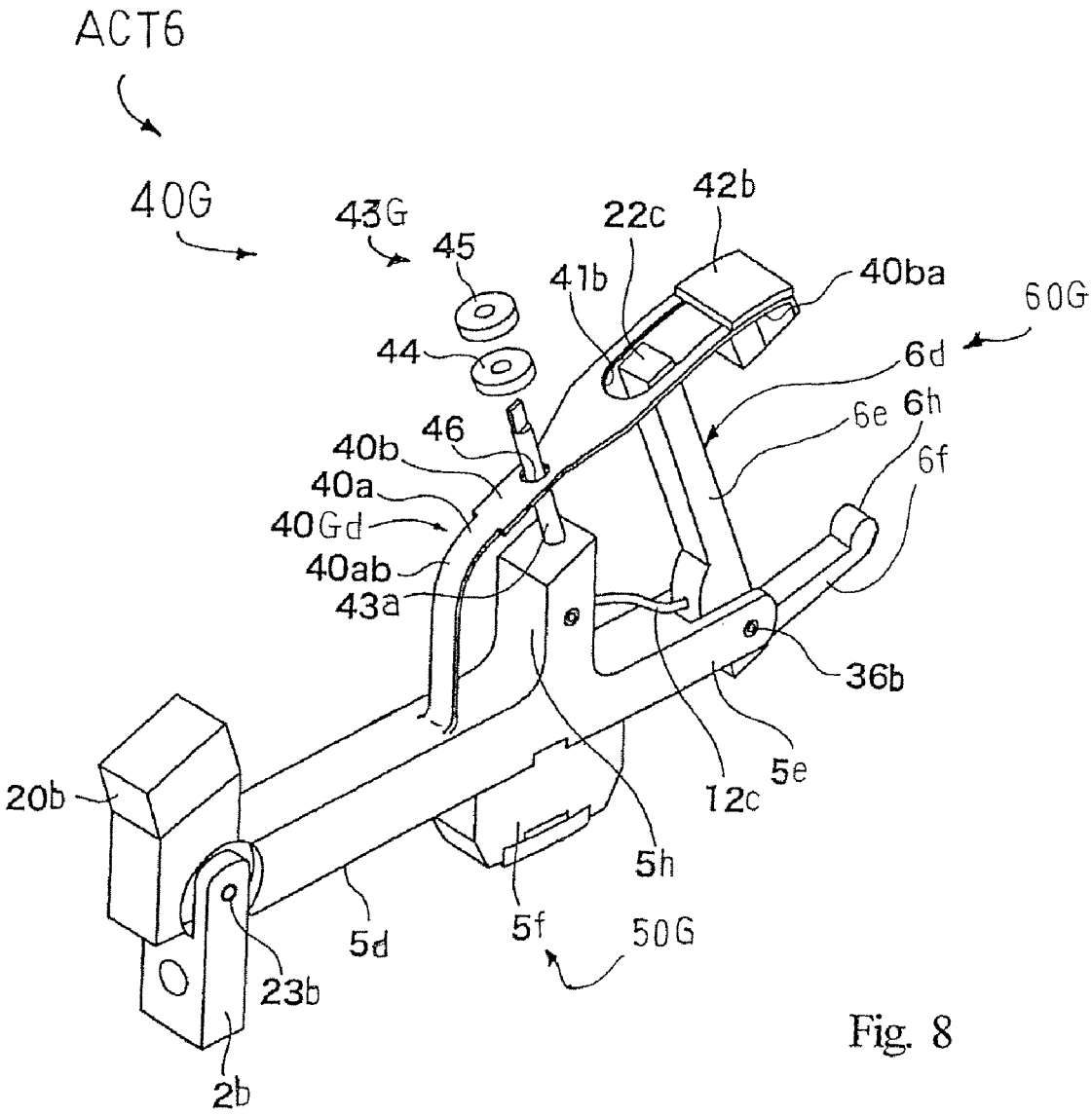
FIG. 8 is a perspective view showing an action unit incorporated in yet another keyboard musical instrument of the present invention.

Turning to FIG. 8, an action unit ACT6 forms a part of a keyboard musical instrument together with other action units, a keyboard, hammer assemblies, strings, dampers and a cabinet. The keyboard, hammer assemblies, strings, dampers and cabinet are similar to the keyboard 30B, hammer assemblies 11*b*, strings 19*b*, dampers DMP2 and piano cabinet CBT2, and, for this reason, are labeled with references designating the corresponding component parts of grand piano without detailed description.

The action unit ACT6 includes a whippen assembly 50G, a jack mechanism 60G and a repetition mechanism 40G. The whippen assembly 50G and jack mechanism 60G are similar to the whippen assembly 5*c* and jack mechanism 6*c*, respectively, except for material of whippen assembly 50G, and, for this reason, components parts of whippen assembly 50G and the component parts of jack mechanism 60G are hereinafter labeled with references designating the corresponding component parts of whippen assembly 5*c* and the component parts of jack mechanism 6*c*. The whippen assembly 50G is made of synthetic resin.

Description is focused on the repetition mechanism 40G. The repetition mechanism 40D includes an elastic guide plate 40Gd, a drop screw (not shown), a repetition skin (not shown) and a load applier 43G. The drop screw, repetition skin and load applier 43G are similar to the drop screw 34*b*, repetition skin 42*b* and load applier 43. For this reason, detailed description on the drop screw, repetition skin and load applier 43G is omitted for avoiding repetition.

The elastic guide plate 40Dd is similar in configuration to the elastic guide plate 40B. A difference from the elastic guide plate 40B is a unitary structure of the whippen assembly 50G and elastic guide plate 40Dd. The elastic guide plate 40G is made of the synthetic resin, and is molded together with the whippen assembly 50G.

The action unit ACT6 achieves all the advantages of the action unit ACT2. Since the whippen assembly 50G and elastic guide plate 40Gd have the unitary structure, the production cost of action unit ACT6 is lower than that of the action unit ACT2.

Although particular embodiments of the present invention have been shown and described, it will be apparent to those skilled in the art that various changes and modifications may be made without departing from the spirit and scope of the present invention.

The grand piano does not set any limit to the technical scope of the present invention. The action units of the present invention are applicable to any sort of keyboard musical instrument in so far as movements of keys are transferred through the action units. The action units of present invention may be incorporated in a celesta, an electronic piano, an automatic player piano, a mute piano or a keyboard for practical usage.

The electronic piano electronically generates the tones through monitoring on the keys as similar to electronic keyboards. However, the action units and quasi-hammers are respectively linked with the keys. The reason why the action units and quasi-hammers are installed in the electronic piano is that the action units and quasi-hammers give the tactile sense of acoustic piano to players.

The automatic player piano is a sort of hybrid keyboard musical instrument, and is a combination between an acoustic piano and an automatic playing system. The automatic playing system includes solenoid-operated key actuators and an information processing system. The solenoid-operated key actuators are respectively provided in association with the keys and pedals. A set of music data codes, which expresses a performance of a music tune, is loaded into the information processing system, and the music data codes are sequentially processed by means of the information processing system. The keys to be depressed and the keys to be released are determined through the information processing, and a driving signal is selectively supplied to or removed from the solenoid-operated key actuators. When the solenoid-operated key actuator is energized, the solenoid-operated key actuators exert force on the associated keys, and give rise to the movements of keys toward the end positions without any fingering of a human player. The movements of keys are transmitted through the action units to the hammers, and the hammers are brought into collision with the strings at the end of free rotation. The action units of the present invention may be employed in the automatic player piano. On the other hand, when the driving signal is removed from the solenoid-operated key actuators, the force is removed from the keys, and the solenoid-operated key actuators permit the keys to return to the rest position. Thus, the automatic playing system performs music tunes on the basis of sets of music data codes.

The mute piano is another sort of hybrid keyboard musical instrument. The mute piano is a combination of an acoustic piano, a hammer stopper and an electronic tone generating system. The hammer stopper is provided between the hammers and the strings, and is changeable between a free position and a blocking position. While the hammer stopper is staying the free position, the hammer stopper is found outside of the loci of hammers, and, accordingly, the hammers are brought into collision with the strings as similar to the standard acoustic piano. On the other hand, when the hammer stopper is changed to the blocking position, the hammer stopper is moved into the loci of hammers. In this situation, even if a player fingers a music tune on the keys, the hammers rebound on the hammer stopper after the escape, and do not reach the strings. On the other hand, the electronic tone generating system monitors the keys, and produces music data codes expressing the tones to be produced and tones to be decayed on the basis of the movements of keys. An audio signal is produced on the basis of the music data codes, and is converted to electronic tones through a headphone. Thus, the pianist can practice the fingering without any disturbance. In both of the modes of operation, the hammers start the free rotation through the escape so that the action units of the present invention are available for the mute piano.

The keyboard for practical usage is similar to a standard acoustic piano except for the strings. In the keyboard for practical usage, the strings are replaced with an impact absorber or a cushion member, and the hammers are brought into the impact absorber or cushion member after the escape. For this reason, the tactile sense on the keys is same as that of the acoustic piano. However, any acoustic piano tone is not generated through the keyboard for practical usage.

The load applier 43 does not set any limit to the technical scope of the present invention. Any combinations of machine elements are available for the repetition mechanism of the present invention. For example, a linkwork such as, for example, a four link mechanism and a stopper may serve as a load applier. The linkwork is connected between the whippen assembly and the elastic guide plate, and a worker varies the distance between the whippen assembly and the elastic guide plate by pressing down the elastic guide plate or releasing it without any substantial resistance of the linkwork. When the elastic guide plate is regulated to the optimum position, the worker locks the linkwork by means of the stopper, and the stopper does not permit the linkwork to change the attitude. Thus, the worker can change the distance and lock the linkwork with the stopper.

Otherwise, a guide rod, a slider and a stopper may be employed as the load applier. The guide rod is fitted to the whippen, and the slider is connected to the elastic guide plate. The slider is slidable on the guide rod. A worker depresses and releases the elastic guide plate, and the slider is moved on the guide rod. When the elastic guide plate reaches the optimum position, the worker locks the slider to the guide rod by means of the stopper so as to keep the elastic guide plate at the optimum position.

A combination of an air cylinder unit and a valve is also available for the load applier. A cylinder body and a rod are fitted to the whippen assembly and the elastic guide plate, respectively, and the valve is attached to the air port of the air cylinder unit. While the valve is opened, the rod projects from and is retracted into the cylinder body together with the elastic guide plate. When the elastic guide plate reaches the optimum position, the valve is closed, and does not permit the rod to move in the cylinder body.

The center projection 5*h* may be replaced with a pedestal, which is secured to the whippen assembly 5*c*. The elastic guide plate may be formed from plural components different in modulus of elasticity.

The maximum width portion of elastic guide plate 40B may be bifurcated so as to allow the leg portion 6*e* to move therein. In this instance, the repetition skin 42*b* bridges the gap at the tip portions of two fingers of bifurcated portion.

In the first embodiment, the jack spring 12*c* is implemented by the metallic wire. However, the metallic wire may be replaced with another sort of spring such as, for example, a coil spring.

The fixed end portion 40*a* may be thinner than the free end portion 40*b* so as to be widely deformed. The free end portion 40*b* may be equal in width to the fixed end portion 40*a*.

The free end portion 40Eb may be bifurcated. In this instance, the semi-circular front portion is removed from the elastic guide member 40E, and the straight portions 46Ea and 46Eb further extends so that the repetition skin 41*b* is fitted to the extensions of straight portions 46Ea and 46Eb. The elastic guide members 40Ed and 40Fd may be made from a rod or rods having a circular cross section or another cross section.

The component parts hereinbefore described are correlated with claim languages as follows.

The grand piano is corresponding to a "keyboard musical instrument". The cabinet CBT2, action brackets ABL2, hammer shank rail 10*b*, support rail 3*b* and damper rail (not shown) as a whole constitute a "housing". The keys 30*b* are corresponding to "plural manipulators", and the hammers 11*b*, strings 19*b* and dampers DMP2 as a whole constitute a "driven linkwork". The hammer shank 16*b*, hammer wood 17*b*, hammer felt 18*b* and hammer roller 14*b* form in combination a "movable portion", and the hammer shank flange 9*b* serves as a "stationary portion".

The jack 6*d*, jack button 31*b*, jack button screw 32*b*, jack stop spoon 33 and jack spring 12*c* form in combination a "movable portion", and the regulating rail 100*b* and regulating button 25*b* serve as a "stationary portion". The elastic guide plate 40B, 40Dd or 40Gd or the elastic guide member 40Ed or 40Fd serves as an "elastically deformable guide".

What is claimed is:

1. A musical instrument for a player, comprising:

a housing;

plural manipulators supported by said housing, and exposed to said player so that said player selectively moves said plural manipulators between rest positions and end positions for specifying tones;

a driven linkwork having a stationary portion supported by said housing and a movable portion rotatable with respect to said stationary portion thereof; and plural action units connected between said plural manipulators and said driven linkwork so as to transmit force applied through said plural manipulators to said driven linkwork, each of said plural action units including a whippen assembly rotatably supported by said housing and driven for rotation by one of said manipulators, a jack mechanism having a stationary portion supported by said housing and a movable portion rotatably supported by said whippen assembly, wherein when said one manipulator is moved from the rest position toward said end position, rotation of said whippen assembly causes said movable portion of the jack mechanism to be brought into contact with said stationary portion thereof thus causing rotation of said movable portion of said jack mechanism about said whippen assembly to drive said movable portion of said driven linkwork, a repetition mechanism having an elastically deformable guide having a substantially uniform thickness and is supported by said whippen assembly, said repetition mechanism being deformed by said stationary portion of said driven linkwork when said jack mechanism is driving said movable portion of said driven linkwork, said repetition mechanism being recovered from the deformation when said one manipulator moves from said end position to said rest position so as to be brought into contact with said movable portion of said driven linkwork for repetition of manipulation on said one manipulator.

2. The musical instrument as set forth in claim 1, in which said driven mechanism includes a tone generator for producing the tones specified through said plural manipulators.

3. The musical instrument as set forth in claim 2, in which said tone generator has plural hammers respectively associated with said plural action units and serving as said movable portion of said driven mechanism, and plural strings respectively associated with said plural hammers and vibrating for producing said tone when said plural hammers are brought into collision with said plural strings.

4. The musical instrument as set forth in claim 1, in which said elastically deformable guide is formed from an elastic plate having a fixed end portion connected to said whippen assembly and a free end portion curved from said fixed end portion so as to have a major surface opposed to said movable portion of said driven linkwork.

5. The musical instrument as set forth in claim 4, in which said movable portion of said driven linkwork has a roller, and said major surface permits said roller to roll thereon in said rotation of said whippen assembly driven by said manipulator moved toward said end position.

6. The musical instrument as set forth in claim 4, in which said fixed end portion has the geometrical moment of inertia less than said free end portion so as to be deformed widely rather than said free end portion.

7. The musical instrument as set forth in claim 6, in which said repetition mechanism further includes a load applier exerting force on said free end portion so as to make said fixed end portion deformed, whereby said elastically deformable guide is brought into an appropriate position with respect to said movable portion of said jack mechanism.

8. The musical instrument as set forth in claim 6, in which said free end portion has flanges projecting from both sides thereof so that said flanges make said geometrical moment of inertia enlarged.

9. The musical instrument as set forth in claim 1, in which said elastically deformable guide is formed from wire rod, and has a fixed end portion connected to said whippen assembly and a free end portion curved from said fixed end portion and looped so as to form a hollow space therein opposed to said movable portion of said driven linkwork.

10. The musical instrument as set forth in claim 9, in which said free end portion is partially cut out in the vicinity of said fixed end portion.

11. The musical instrument as set forth in claim 9, in which said repetition mechanism further has a load applier exerting force on said free end portion so as to make said fixed end portion deformed, whereby said elastically deformable guide is brought into an appropriate position with respect to said movable portion of said jack mechanism.

12. The musical instrument as set forth in claim 1, in which said whippen assembly and said elastically deformable guide are made of synthetic resin, and have a unitary structure.

13. An action unit incorporated in a musical instrument together with other action units, plural manipulators and a driven linkwork, the musical instrument having a housing, the action unit comprising:

a whippen assembly rotatably supported by said housing of said musical instrument, and driven for rotation by one of said manipulators moved between a rest position and an end position;

a jack mechanism having a stationary portion supported by said housing and a movable portion rotatably supported by said whippen assembly, wherein when said one manipulator is moved from the rest position toward said end position, rotation of said whippen assembly causes said movable portion of the jack mechanism to be brought into contact with said stationary portion thereof thus causing rotation of said movable portion of said jack mechanism about said whippen assembly to drive a movable portion of said driven linkwork; and a repetition mechanism having an elastically deformable guide having a substantially uniform thickness and is supported by said whippen assembly, said repetition mechanism being deformed by a stationary portion of said driven linkwork when said jack mechanism is driving said movable portion of said driven linkwork, said repetition mechanism being recovered from the deformation when said one of said manipulators moves from said end position to said rest position so as to be brought into contact with said movable portion of said driven linkwork for repetition of manipulation on said one of said manipulators.

14. The action unit as set forth in claim 13, in which said elastically deformable guide is formed from an elastic plate having a fixed end portion connected to said whippen assembly and a free end portion curved from said fixed end portion so as to have a major surface opposed to said movable portion of said driven linkwork.

15. The action unit as set forth in claim 14, in which said movable portion of said driven linkwork has a roller, and said major surface permits said roller to roll thereon in said rotation of said whippen assembly driven by said manipulator moved toward said end position.

16. The action unit as set forth in claim 14, in which said fixed end portion has the geometrical moment of inertia less than said free end portion so as to be deformed widely rather than said free end portion.

17. The action unit as set forth in claim 13, in which said repetition mechanism further includes a load applier exerting force on said free end portion so as to make said fixed end portion deformed, whereby said elastically deformable guide is brought into an appropriate position with respect to said movable portion of said jack mechanism.

18. The action unit as set forth in claim 16, in which said free end portion has flanges projecting from both sides thereof so that said flanges make said geometrical moment of inertia enlarged.

19. The action unit as set forth in claim 13, in which said elastically deformable guide is formed from wire rod, and has a fixed end portion connected to said whippen assembly and a free end portion curved from said fixed end portion and looped so as to form a hollow space therein opposed to said movable portion of said driven linkwork.

20. The action unit as set forth in claim 13, in which said whippen assembly and said elastically deformable guide are made of synthetic resin, and have a unitary structure.

* * * * *